US007141077B2

(12) United States Patent
Detering et al.

(10) Patent No.: US 7,141,077 B2
(45) Date of Patent: Nov. 28, 2006

(54) HYDROPHOBICALLY MODIFIED POLYETHYLENIMINES AND POLYVINYLAMINES FOR WRINKLE-RESISTANT FINISHING OF TEXTILES CONTAINING CELLULOSE

(75) Inventors: Juergen Detering, Limburgerhof (DE); Guenther Grimm, Ludwigshafen (DE); Torsten Freund, Limburgerhof (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 228 days.

(21) Appl. No.: 10/477,208

(22) PCT Filed: May 16, 2002

(86) PCT No.: PCT/EP02/05424

§ 371 (c)(1),
(2), (4) Date: Nov. 18, 2003

(87) PCT Pub. No.: WO02/095122

PCT Pub. Date: Nov. 28, 2002

(65) Prior Publication Data

US 2004/0139559 A1 Jul. 22, 2004

(30) Foreign Application Priority Data

May 18, 2001 (DE) ..... 101 24 387

(51) Int. Cl.
*D06M 15/61* (2006.01)

(52) U.S. Cl. ..... 8/137; 510/276; 510/475; 510/513; 510/515

(58) Field of Classification Search ..... 510/276, 510/475, 513; 8/137
See application file for complete search history.

(56) References Cited

U.S. PATENT DOCUMENTS 4,011,613 A 3/1977 Bertoniere et al.
4,520,143 A 5/1985 Jellinek
5,879,749 A 3/1999 Rodrigues et al.

FOREIGN PATENT DOCUMENTS

| | | |
|---|---|---|
| DE | 100 08 930 | 8/2001 |
| DE | 100 60 373 | 6/2002 |
| EP | 0 300 525 | 1/1989 |
| EP | 0 978 556 | 2/2000 |
| JP | 49 037000 | 4/1974 |
| WO | 92/01773 | 2/1992 |
| WO | WO 97/42285 | * 11/1997 |
| WO | 98/04772 | 2/1998 |
| WO | 99/55953 | 11/1999 |
| WO | 00/24853 | 5/2000 |

* cited by examiner

*Primary Examiner*—Margaret Einsmann
(74) *Attorney, Agent, or Firm*—Oblon, Spivak, McClelland, Maier & Neustadt, P.C.

(57) ABSTRACT

A process for wrinkleproofing cellulosic textiles comprises treating the textiles with a finish and drying the treated textiles, wherein the finish comprises one or more water-soluble or water-dispersible hydrophobically modified polyethyleneimines and/or polyvinylamines.

Suitable hydrophobically modified polyethyleneimines are hydrophobically modified homopolymers of ethyleneimine, hydrophobically modified graft polymers of polyamidoamines or of polyvinylamines. Suitable hydrophobically modified polyvinylamines are hydrophobically modified at least partially hydrolyzed homo- or copolymers of N-vinylcarboxamides. The polyethyleneimines and polyvinylamines can be crosslinked by polyfunctional crosslinking compounds, quaternized and/or modified by reaction with alkylene oxides, dialkyl carbonates, alkylene carbonates and/or $C_1$–$C_4$-carboxylic acids.

Suitable hydrophobicizing reagents are selected from the group consisting of long-chain linear or branched linear carboxylic acids, linear or branched alkyl halides, alkyl epoxides, alkylketene dimers, cyclic dicarboxylic anhydrides, alkyl isocyanates and chloroformic esters of fatty alcohols.

10 Claims, No Drawings

HYDROPHOBICALLY MODIFIED POLYETHYLENIMINES AND POLYVINYLAMINES FOR WRINKLE-RESISTANT FINISHING OF TEXTILES CONTAINING CELLULOSE

This invention relates to processes for wrinkleproofing cellulosic textiles, the use of hydrophobically modified polyethyleneimines and polyvinylamines as antiwrinkle additives and also textile treatment compositions, solid and liquid laundry detergent compositions and laundry conditioning rinse compositions comprising the hydrophobically modified polyethyleneimines and polyvinylamines.

Cellulosic textiles are given easy care properties for example by treatment with condensation products of urea, glyoxal and formaldehyde. The finish is applied during the manufacture of textile materials. Softening compounds are frequently further applied with the finish. Thus finished textiles are less wrinkled and creased, easier to iron and softer and smoother after laundering compared with untreated cellulose textiles.

WO 92/01773 discloses the use of microemulsified aminosiloxanes in fabric conditioners to reduce wrinkling and creasing during the laundering process. In addition, the use of aminosiloxanes is said to facilitate ironing.

WO 98/4772 discloses a process for pretreating textile materials by applying a mixture of a polycarboxylic acid and a cationic softener to the textile materials. Wrinkle control is obtained as a result.

EP-A 0 300 525 discloses fabric conditioners based on crosslinkable amino-functionalized silicones that impart wrinkle control or an easy-iron effect to textiles treated therewith.

WO 99/55953 discloses fabric wrinkle control compositions. They comprise lubricants, shape retention polymers, lithium salts and optionally further ingredients such as softeners, ionic and nonionic surfactants, odor control agents and bactericides. The formulation is preferably applied to the textile material by spraying.

EP-A 0 978 556 describes a mixture of a softener and crosslinker component having cationic properties as a fabric wrinkle and crease control composition and also a method of wrinkleproofing textiles.

WO 00/24853 describes a fabric softening formulation which provides wrinkle reducing benefits to the treated textiles. The wrinkle reducing agents used are preferably modified silicones such as aminopolydimethylsiloxane-polyalkylene oxide copolymers or sulfated or sulfonated vegetable oils such as sulfated castor oil.

It is an object of the present invention to provide a further process for wrinkleproofing cellulosic textiles and also further finishes for wrinkleproofing such textiles.

We have found that this object is achieved by a process for wrinkleproofing cellulosic textiles by treating the textiles with a finish and drying the treated textiles, wherein the finish comprises one or more water-soluble or water-dispersible hydrophobically modified polyethyleneimines and/or polyvinylamines.

The invention also provides a wrinkleproofing finish for cellulosic textiles that comprises hydrophobically modified polyethyleneimines and/or hydrophobically modified polyvinylamines.

Polyethyleneimines

Polyethyleneimines which, according to the invention, are useful as antiwrinkle additives in hydrophobically modified form include for the purposes of the present invention the homopolymers of ethyleneimine (aziridine) or its higher homologues and also the graft polymers of polyamidoamines or polyvinylamines with ethyleneimine or its higher homologues. The polyethyleneimines can be crosslinked or uncrosslinked, quaternized and/or modified by reaction with alkylene oxides, dialkyl or alkylene carbonates or C1- to C4-carboxylic acids.

A Homopolymers of Ethyleneimine (Aziridine)

Useful polyethyleneimines for hydrophobic modification include polyethyleneimine homopolymers, which can be used in crosslinked or uncrosslinked form. Polyethyleneimine homopolymers are preparable according to known processes, for example Römpps Chemie Lexikon, 8th edition 1992, pages 3532–3533, or in Ullmann's Enzyklopädie der Technischen Chemie, 4th edition 1974, Volume 8, pages 212–213 and the references cited therein. They have a molecular weight in the range from about 200 to 1 000 000 g/mol. Higher molecular weight polymers are obtained by crosslinking with polyfunctional compounds.

Useful polyfunctional crosslinking compounds include diisocyanates such as hexamethylene diisocyanate, isophorone diisocyanate, dicyclohexylmethane 4,4'-diisocyanate and diphenylmethane diisocyanate, dihaloalkanes such as 1,2-dichloroethane, 1,3-dichloropropane, 1,4-dichlorobutane and 1,6-dichlorohexane, diepoxides such as oligo- and polyethylene glycol bisepoxides, epihalohydrins such as epichlorohydrin, bischlorohydrin ethers of alkylene glycols and polyalkylene glycols with 2 to 100 ethylene oxides and/or propylene oxide units, alkylene carbonates such as ethylene carbonate and propylene carbonate and bischloroformates such as 2,2-dimethylpropylene bischloroformate.

B Graft Polymers of Polyamidoamines with Ethyleneimine

Polyethyleneimines for the purposes of the present invention further include ethyleneimine polymers obtainable by grafting polyamidoamines with ethyleneimine. These can be crosslinked by the crosslinkers mentioned under A.

Grafted polyamidoamines are known for example from U.S. Pat. No. 4,144,123 or DE-B-24 34 816. The polyamidoamines are obtainable for example by condensation of (i) polyalkylenepolyamines, which can be present in a mixture with diamines, with (ii) at least dibasic carboxylic acids such as oxalic acid, malonic acid, succinic acid, maleic acid, fumaric acid, itaconic acid, adipic acid, tartaric acid, citric acid, propanetricarboxylic acid, butanetetracarboxylic acid, glutaric acid, suberic acid, sebacic acid, terephthalic acid and esters thereof, acyl chlorides or anhydrides which can be present in a mixture with up to 50 mol % of monobasic amino acids, monobasic hydroxycarboxylic acids and/or monobasic carboxylic acids, in a molar ratio of (i) to (ii) of 1:0.5 to 1:2.

Polyalkylenepolyamines are compounds containing at least 3 basic nitrogen atoms in the molecule, for example diethylenetriamine, dipropylenetriamine, triethylenetetramine, tripropylenetetramine, tetraethylenepentamine, pentaethylenehexamine, N-(2-aminoethyl)-1,3-propanediamine and N,N'-bis(3-aminopropyl)ethylenediamine.

Useful diamines include for example 1,2-diaminoethane, 1,3-diaminopropane, 1,4-diamino-butane, 1,6-diaminohexane, 1,8-diaminooctane, isophoronediamine, 4,4'-diaminodiphenyl-methane, 1,4-bis(3-aminopropyl)piperazine, 4,9-dioxadodecane-1,12-diamine, 4,7,10-tri-oxatridecane-1,13-diamine or a,z-diamino compounds of polyalkylene oxides.

The condensation of the compounds (i) and (ii) is effected as described in EP-B 0 703 972 for example.

The graft polymers generally contain from 10 to 90% by weight of polyamidoamines as a grafting base and from 90 to 10% by weight of ethyleneimine as a graft.

C Graft Polymers of Polyvinylamines with Ethyleneimine

Useful polyethyleneimines for the purposes of the present invention also include ethyleneimine polymers obtainable by grafting polyvinylamines with ethyleneimine. Polyvinylamines are obtainable by partial or complete hydrolysis of polymers of open-chain N-vinylcarboxamides of the general formula (I)

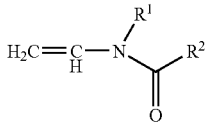

(I)

where R1 and R2 are each H or C1- to C6-alkyl, and are more particularly described under E and F (see hereinbelow). The degree of hydrolysis is generally in the range from 5 to 100%. The graft polymers can be crosslinked by the crosslinkers mentioned under A.

The graft polymers generally contain from 10 to 90% by weight of polyvinylamines as a grafting base and from 90 to 10% by weight of ethyleneimine as a graft.

D Polyalkyleneimines

Polyethyleneimines useful for the purposes of the present invention also include the polymers of higher homologues of ethyleneimine which correspond to the compounds mentioned under A to C, such as propyleneimine (2-methylaziridine), 1- or 2-butyleneimine (2-ethylaziridine or 2,3-dimethylaziridine). However, the polymers of ethyleneimine are preferred.

The polyethyleneimines mentioned under A to D may be modified by reaction with alkylene oxides such as ethylene oxide, propylene oxide or butylene oxide, dialkyl carbonates such as dimethyl carbonate and diethyl carbonate, alkylene carbonates such as ethylene carbonate or propylene carbonate, or C1–C4-carboxylic acids. The modification can be effected before or after the hydrophobicizing step (see hereinbelow).

The polyethyleneimines or polyvinylamines mentioned under A to D may also be present in quaternized form. Useful quaternizing agents include alkylating agents such as dimethyl sulfate, diethyl sulfate, methyl chloride, methyl iodide, ethyl chloride or benzyl chloride. The quaternization can be effected before or after the hydrophobicizing step (see hereinbelow).

Polyvinylamines

Polyvinylamines which, according to the invention, are useful as antiwrinkle additives in hydrophobically modified form include for the purposes of the present invention the homo- or copolymers of N-vinylcarboxamides, which are at least partially hydrolyzed. The polyvinylamines can be crosslinked or uncrosslinked, quaternized and/or modified by reaction with alkylene oxides, dialkyl or alkylene carbonates or C1- to C4-carboxylic acids.

E At Least Partially Hydrolyzed N-vinylcarboxamide Homopolymers

They are prepared for example from open-chain N-vinylcarboxamides of the above formula (I). Useful monomers include for example N-vinylformamide (R1=R2=H in the formula I), N-vinyl-N-methylformamide (R1=methyl, R2=H in the formula I), N-vinylacetamide (R1=H, R2=methyl in the formula I), N-vinyl-N-methylacetamide, (R1=R2=methyl in the formula I) and N-vinyl-N-ethylacetamide (R1=ethyl, R2=methyl in the formula I). N-Vinylformamide is preferred.

F At Least Partially Hydrolyzed N-vinylcarboxamide Copolymers

Polyvinylamines for the purposes of the invention also include copolymers of (a) from 0.1 to 100 mol % of N-vinylcarboxamides of the formula I and (b) from 0 to 99.9 mol % of vinyl formate, vinyl acetate, vinyl propionate, vinyl alcohol, N-vinylurea, N-vinylpyrrolidone, N-vinylpiperidone, N-vinylcaprolactam, N,N-divinylethyleneurea and/or N-vinylimidazole, (a) and (b) adding up to 100 mol %, which are at least partially hydrolyzed.

The polymers have a K value of from 5 to 300 (determined according to H. Fikentscher, Cellulose Chemie, Volume 13, pages 58–64 and 71–74 (1932), in 5% by weight aqueous sodium chloride solution at 25° C. and a polymer concentration of 0.5% by weight). Useful N-vinylcarboxamides include the compounds mentioned under E. N-Vinylformamide is preferred.

The polymers mentioned under E and F are at least partially hydrolyzed, i.e., the amide groups originally present in the polymers have been converted into amino groups by hydrolysis to an extent in the range from 5 to 100%, preferably in the range from 20 to 100% and particularly preferably in the range from 40 to 100%. The hydrolysis can be effected not only in an alkaline but also in an acidic medium.

The vinylamine polymers and copolymers used according to the invention are prepared according to processes known for example from U.S. Pat. No. 4,421,602, EP-A-02 16 387 and EP-A-0 251 182.

The polyvinylamines mentioned under E and F may also be crosslinked. Useful crosslinkers include the crosslinkers mentioned under A.

The polyvinylamines mentioned under E and F may be modified by reaction with alkylene oxides such as ethylene oxide, propylene oxide or butylene oxide, dialkyl carbonates such as dimethyl carbonate and diethyl carbonate, alkylene carbonates such as ethylene carbonate or propylene carbonate or C1–C4-carboxylic acids. The modification can be effected before or after the hydrophobicizing step (see hereinbelow).

The polyvinylamines mentioned under E and F may also be present in quaternized form. Suitable quaternizing agents include alkylating agents such as dimethyl sulfate, diethyl sulfate, methyl chloride, methyl iodide, ethyl chloride or benzyl chloride. A quaternization can be effected before or after the hydrophobicizing step (see hereinbelow).

Hydrophobic Modification

The polyethyleneimines A to D and polyvinylamines E and F used according to the invention are hydrophobically modified. Hydrophobically modified for the purposes of the present invention means that, in the polymers recited under A to F, the hydrogen atoms of the primary and secondary amino groups are at least partially replaced by linear or branched alkyl, alkenyl, hydroxyalkyl or alkylcarboxy radicals having 10 to 22 carbon atoms and preferably 14 to 18 carbon atoms in the alkyl radical, which may carry further substituents such as carboxyl groups.

The polymers described above under A to F are hydrophobically modified by reaction with long-chain linear or branched carboxylic acids having 10 to 22 carbon atoms and preferably 14 to 18 carbon atoms in the alkyl or alkylene radical, such as capric acid, undecanoic acid, lauric acid, tridecanoic acid, myristic acid, pentadecanoic acid, palmitic acid, margaric acid, stearic acid, nonadecanoic acid, arachidic acid, behenic acid, palmitoleic acid, oleic acid, linoleic acid, linolenic acid, arachidonic acid and mixtures thereof, preferably stearic acid, palmitic acid and oleic acid, or the acyl chlorides, esters or anhydrides of the carboxylic acids mentioned, linear or branched alkyl halides having 10 to 22 carbon atoms and preferably 14 to 18 carbon atoms in the alkyl radical, such as tetradecyl chloride, hexadecyl chloride, octadecyl chloride and mixtures thereof, alkyl epoxides having 10 to 22 carbon atoms and preferably 14 to 18 carbon atoms, such as hexadecenyl oxide and octadecenyl oxide and mixtures thereof, alkylketene dimers having 10 to 22 carbon atoms and preferably 14 to 18 carbon atoms in the alkyl radical, such as laurylketene, palmitylketene, stearylketene and oleylketene dimers and mixtures thereof, cyclic dicarboxylic anhydrides, especially alkyl-substituted succinic anhydrides having 10 to 22 carbon atoms and preferably 14 to 18 carbon atoms in the alkyl radical, such as dodecenylsuccinic anhydride, tetradecylsuccinic anhydride, hexadecenylsuccinic anhydride and mixtures thereof, alkyl isocyanates having 10 to 22 carbon atoms and preferably 14 to 18 carbon atoms in the alkyl radical, such as tetradecyl isocyanate, hexadecyl isocyanate, octadecyl isocyanate and mixtures thereof, or chloroformic esters of fatty alcohols having 10 to 22 carbon atoms and preferably 14 to 18 carbon atoms.

The degree of hydrophobicization is in the range from 0.1 to 20% by weight, preferably in the range from 0.3 to 10% by weight, particularly preferably in the range from 0.5 to 7% by weight of the abovementioned hydrophobicization reagents, based on the weight of the ready-prepared product.

The invention also provides for the use of the hydrophobically modified polyethyleneimines and polyvinylamines in finishes for wrinkleproofing cellulosic textiles. Finishes are any liquid formulations which contain the hydrophobically modified polyethyleneimines or polyvinylamines in dissolved or dispersed form for application to the textile material. The finishes of the invention can be present for example as finishes in the narrower sense in the manufacture of textiles or in the form of an aqueous washing liquor or as a liquid textile treatment composition. Useful solvents include for example water, alcohols such as methanol, ethanol and propanol, THF or mixtures thereof. It is possible for example to treat textiles with the finish in the course of their manufacture. Textiles which have not been adequately finished, if at all, may be treated with a textile treatment composition which contains the hydrophobically modified polyethyleneimines or polyvinylamines, for example before or after home laundering, for example during ironing. But it is also possible to treat the textiles with hydrophobically modified polyethyleneimines or polyvinylamines in the main wash cycle or after the main wash cycle in the conditioning or softening rinse cycle of the washing machine.

The present invention also provides for the use of the hydrophobically modified polyethyleneimines and polyvinylamines in the manufacture of textiles, in the treatment of textiles before or after laundering, in the laundry main wash cycle, in the laundry rinse cycle and during ironing. Different formulations are needed in each case.

The treatment before or after laundering may utilize a textile treatment composition which, as well as hydrophobically modified polyethyleneimines or polyvinylamines in dissolved or dispersed form, contains a surfactant. In this treatment, the cellulosic textiles are for example sprayed with the hydrophobically modified polyethyleneimines or polyvinylamines with an add-on which is generally in the range from 0.01 to 10% by weight, preferably in the range from 0.1 to 7% by weight and particularly preferably in the range from 0.3 to 4% by weight, based on the weight of the dry textile material. But the finish may also be applied to the textile material by dipping the textiles into a bath which contains generally from 0.1 to 10% by weight and preferably from 0.3 to 5% by weight, based on the weight of the dry textile material, of hydrophobically modified polyethyleneimines or polyvinylamines in dissolved or dispersed form. The textile material is either dipped only briefly into the bath or else allowed to dwell therein for a period of from 1 to 30 min for example.

Cellulosic textiles which have been treated with the finish either by spraying or by dipping are if necessary squeezed off and dried. Drying may take place in air or else in a dryer or else by subjecting the treated textile material to hot ironing. The finish becomes fixed on the textile material in the course of drying. The best conditions in each case are readily ascertainable by experimentation. The temperatures for drying, including ironing, are for example in the range from 40 to 150° C. and preferably in the range from 60 to 110° C. For ironing, the cotton program of the iron is suitable in particular. Textiles treated with the hydrophobically modified polyethyleneimines or polyvinylamines in dissolved or dispersed form according to the above-described process exhibit an excellent level of wrinkle and crease resistance that is durable to multiple laundering. There is frequently no longer any need to iron the textiles. The textiles thus treated additionally possess fiber and color protection.

The invention also provides a textile treatment composition comprising a) from 0.1 to 40% by weight and preferably from 0.5 to 25% by weight of at least one hydrophobically modified polyethyleneimine and/or polyvinylamine, b) from 0 to 30% by weight of one or more silicones, c) from 0 to 30% by weight of one or more cationic and/or nonionic surfactants, d) from 0 to 60% by weight of further ingredients such as further wetting agents, softeners, lubricants, water-soluble, film-forming and adhesive polymers, scents, colorants, stabilizers, fiber and color protection additives, viscosity modifiers, soil release additives, corrosion control additives, bactericides, preservatives and spraying assistants, and e) from 0 to 99.9% by weight of water, the components a) to e) adding up to 100% by weight.

Preferred silicones b) are amino-containing silicones, which are preferably present in microemulsified form, alkoxylated, especially ethoxylated, silicones, polyalkylene oxide-polysiloxanes, polyalkylene oxide-aminopolydimethylsiloxanes, silicones having quaternary ammonium groups (silicone quats) and silicone surfactants.

Useful softeners or lubricants include for example oxidized polyethylenes or paraffinic waxes and oils. Useful water-soluble, film-forming and adhesive polymers include for example (co)polymers based on acrylamide, N-vinylpyrrolidone, vinylformamide, N-vinylimidazole, vinylamine, N,N'-dialkylaminoalkyl (meth)acrylates, N,N'-dialkylaminoalkyl(meth)acrylamides, (meth)acrylic acid, alkyl (meth) acrylates and/or vinylsulfonate. The aforementioned basic monomers may also be used in quaternized form.

A textile pretreatment formulation to be applied to the textile material by spraying may additionally include a spraying assistant. In some cases, it can also be of advantage to include in the formulation alcohols such as ethanol, isopropanol, ethylene glycol or propylene glycol. Further customary additives are scents, colorants, stabilizers, fiber and color protection additives, viscosity modifiers, soil release additives, corrosion control additives, bactericides and preservatives in customary amounts.

The textile treatment composition may generally also be applied by spraying in the course of ironing after laundering. This not only substantially facilitates ironing, but also imparts sustained wrinkle and crease resistance to the textiles.

The hydrophobically modified polyethyleneimines and polyvinylamines may also be used when the textiles are washed in the main wash cycle of the washing machine.

The invention further provides a solid laundry detergent composition comprising a) from 0.05 to 20% by weight of at least one hydrophobically modified polyethyleneimine and/or polyvinylamine,
b) from 0 to 20% by weight of one or more silicones,
c) from 0.1 to 40% by weight of at least one nonionic and/or anionic surfactant,
d) from 0 to 50% by weight of one or more inorganic builders,
e) from 0 to 10% by weight of one or more organic cobuilders,
f) from 0 to 60% by weight of other customary ingredients such as standardizers, enzymes, perfume, complexing agents, corrosion inhibitors, bleaches, bleach activators, cationic surfactants, bleach catalysts, dye transfer inhibitors, antiredeposition agents, soil release polyesters, colorants, bactericides, dissolution improvers and/or disintegrants, components a) to f) adding up to 100% by weight.

A solid laundry detergent formulation according to the invention is customarily present in powder, granule, extrudate or tablet form.

The invention further provides a liquid laundry detergent composition comprising a) from 0.05 to 20% by weight of at least one hydrophobically modified polyethyleneimine and/or polyvinylamine,
b) from 0 to 20% by weight of one or more silicones,
c) from 0.1 to 40% by weight of at least one nonionic and/or anionic surfactant,
d) from 0 to 20% by weight of one or more inorganic builders,
e) from 0 to 10% by weight of one or more organic cobuilders,
f) from 0 to 60% by weight of other customary ingredients such as sodium carbonate, enzymes, perfume, complexing agents, corrosion inhibitors, bleaches, bleach activators, bleach catalysts, cationic surfactants, dye transfer inhibitors, antiredeposition agents, soil release polyesters, colorants, bactericides, nonaqueous solvents, solubilizers, hydrotropes, thickeners and/or alkanolamines,
g) from 0 to 99.85% by weight of water, components a) to g) adding up to 100% by weight.

Useful silicones b) include the abovementioned silicones.

Useful anionic surfactants c) are in particular:

(fatty) alcohol sulfates of (fatty) alcohols having from 8 to 22, preferably from 10 to 18, carbon atoms, for example C9- to C1 -alcohol sulfates, C12- to C14-alcohol sulfates, C12- to C18-alcohol sulfates, lauryl sulfate, cetyl sulfate, myristyl sulfate, palmityl sulfate, stearyl sulfate and tallow fatty alcohol sulfate;

sulfated alkoxylated C8- to C22-alcohols (alkyl ether sulfates). Compounds of this kind are prepared for example by first alkoxylating a C8- to C22-alcohol, preferably a C10- to C18-alcohol, for example a fatty alcohol, and then sulfating the alkoxylation product. The alkoxylation is preferably carried out using ethylene oxide;

linear C8- to C20-alkylbenzenesulfonates (LAS), preferably linear C9- to C13-alkylbenzenesulfonates and -alkyltoluenesulfonates, alkanesulfonates such as C8- to C24-alkanesulfonates, preferably C10- to C18-alkanesulfonates;

soaps such as, for example, the sodium and potassium salts of C8- to C24-carboxylic acids.

The anionic surfactants mentioned are preferably included in the laundry detergent in the form of salts. Suitable cations in these salts are alkali metal ions such as sodium, potassium and lithium and ammonium ions such as hydroxyethylammonium, di(hydroxyethyl)ammonium and tri(hydroxyethyl)ammonium.

Useful nonionic surfactants c) are in particular:

alkoxylated C8- to C22-alcohols such as fatty alcohol alkoxylates or oxo alcohol alkoxylates. These may have been alkoxylated with ethylene oxide, propylene oxide and/or butylene oxide. Useful surfactants here include all alkoxylated alcohols which contain at least two molecules of one of the aforementioned alkylene oxides. Here it is possible to use block polymers of ethylene oxide, propylene oxide and/or butylene oxide or addition products which contain the aforementioned alkylene oxides in random distribution. Nonionic surfactants generally contain from 2 to 50, preferably from 3 to 20, mol of at least one alkylene oxide per mole of alcohol. The alkylene oxide component is preferably ethylene oxide. The alcohols preferably have from 10 to 18 carbon atoms. Depending on the type of alkoxylation catalyst used to make them, alkoxylates have a broad or narrow alkylene oxide homolog distribution;

alkylphenol alkoxylates such as alkylphenol ethoxylates having C6- to C14-alkyl chains and from 5 to 30 alkylene oxide units;

alkylpolyglucosides having from 8 to 22, preferably from 10 to 18, carbon atoms in the alkyl chain and generally from 1 to 20, preferably from 1.1 to 5, glucoside units;

N-alkylglucamides, fatty acid amide alkoxylates, fatty acid alkanolamide alkoxylates and also block copolymers of ethylene oxide, propylene oxide and/or butylene oxide.

Useful inorganic builders d) are in particular:

crystalline or amorphous aluminosilicates having ion-exchanging properties such as zeolites in particular. Useful zeolites include in particular zeolites A, X, B, P, MAP and HS in their sodium form or in forms in which sodium has been partly replaced by other cations such as lithium, potassium, calcium, magnesium or ammonium;

crystalline silicates such as in particular disilicates or sheet-silicates, for example δ-Na2Si2O5 or β-Na2Si2O5. Silicates can be used in the form of their alkali metal, alkaline earth metal or ammonium salts, preferably as sodium, lithium and magnesium silicates;

amorphous silicates such as for example sodium metasilicate or amorphous disilicate;

carbonates and bicarbonates. These can be used in the form of their alkali metal, alkaline earth metal or ammonium salts. Preference is given to sodium, lithium and magnesium carbonates or bicarbonates, especially sodium carbonate and/or sodium bicarbonate;

polyphosphates such as for example pentasodium triphosphate.

Useful organic cobuilders e) include in particular low molecular weight, oligomeric or polymeric carboxylic acids.

Useful low molecular weight carboxylic acids include for example citric acid, hydrophobically modified citric acid such as for example agaric acid, malic acid, tartaric acid, gluconic acid, glutaric acid, succinic acid, imidodisuccinic acid, oxydisuccinic acid, propanetricarboxylic acid, butanetetracarboxylic acid, cyclopentanetetracarboxylic acid, alkyl- and alkenylsuccinic acids and aminopoly-carboxylic acids such as for example nitrilotriacetic acid, β-alaninediacetic acid, ethylenediaminetetraacetic acid, serinediacetic acid, isoserinediacetic acid, N-(2-hydroxyethyl)iminodiacetic acid, ethylenediaminedisuccinic acid and methyl- and ethylglycinediacetic acid;

useful oligomeric or polymeric carboxylic acids include for example homopolymers of acrylic acid, oligomaleic acids, copolymers of maleic acid with acrylic acid, methacrylic acid, C2–C22-olefins such as for example isobutene or long-chain α-olefins, vinyl alkyl ethers having C1–C8-alkyl groups, vinyl acetate, vinyl propionate, (meth)acrylic esters of C1–C8-alcohols and styrene. Preference is given to using the homopolymers of acrylic acid and copolymers of acrylic acid with maleic acid. Polyaspartic acids are also useful as organic cobuilders. Oligomeric and polymeric carboxylic acids are used in acid form or as sodium salt.

Useful bleaches include for example adducts of hydrogen peroxide with inorganic salts such as sodium perborate monohydrate, sodium perborate tetrahydrate or sodium carbonate perhydrate or percarboxylic acids such as phthalimidopercaproic acid.

Useful bleach activators include for example N,N,N',N'-tetraacetylethylenediamine (TAED), sodium p-nonanoyloxybenzenesulfonate or N-methylmorpholinium acetonitrile methosulfate.

Preferred enzymes which are used in laundry detergent compositions are proteases, lipases, amylases, cellulases, oxidases or peroxidases.

Useful dye transfer inhibitors include for example homo- and copolymers of 1-vinylpyrrolidone, of 1-vinylimidazole or of 4-vinylpyridine N-oxide. Homo- and copolymers of 4-vinylpyridine which have been reacted with chloroacetic acid are likewise useful as dye transfer inhibitors.

A detailed description of the laundry detergent ingredients mentioned is found for example in WO 99/06524 or WO 99/04313 and in Liquid Detergents, Editor: Kuo-Yann Lai, Surfactant Sci. Ser., Vol. 67, Marcel Decker, New York, 1997, pp. 272–304.

The concentration of the hydrophobically modified polyethyleneimines or the polyvinylamines in the wash liquor is for example in the range from 10 to 5 000 ppm, preferably in the range from 50 to 1 000 ppm. Textiles treated with the hydrophilically modified polyethyleneimines or polyvinylamines in the main wash cycle of the washing machine not only wrinkle substantially less than untreated textiles, they are also easier to iron, softer and smoother, more dimensionally and shape stable and, because of their fiber and color protection, look less "used", i.e., exhibit less fluff and fewer knots and less color damage or fading, after repeated washing.

The hydrophobically modified polyethyleneimines and/or polyvinylamines may be used in the rinse or conditioning cycle following the main wash cycle. The concentration of the hydrophobically modified polyethyleneimines or the polyvinylamines in the wash liquor is for example in the range from 10 to 5 000 ppm, preferably in the range from 50 to 1 000 ppm. The rinse liquor may if desired include ingredients typical for a fabric conditioner or refresher. Textiles treated in this way and then dried on the line or preferably in a tumble dryer likewise exhibit a very high level of crease resistance that is associated with the positive effects on ironing that were described above. Crease resistance can be substantially enhanced by briefly ironing the textiles once after drying. The treatment in the softening or conditioning rinse cycle also has a favorable effect on the shape retention of the textiles. It further inhibits the formation of knots and fluff and suppresses color damage.

The invention further provides a laundry conditioning rinse composition comprising a) from 0.05% to 40% by weight of at least one hydrophobically modified polyethyleneimine and/or polyvinylamine, b) from 0 to 20% by weight of one or more silicones, c) from 0.1 to 40% by weight of at least one cationic surfactant, d) from 0 to 30% by weight of one or more nonionic surfactants, e) from 0 to 30% by weight of further customary ingredients such as lubricants, wetting agents, film-forming polymers, scents, colorants, stabilizers, fiber and color protection additives, viscosity modifiers, soil release additives, corrosion control additives, bactericides and preservatives, and f) from 0 to 99.85% by weight of water, components a) to f) adding up to 100% by weight.

Preferred silicones b) are the aforementioned silicones.

Preferred cationic surfactants c) are selected from the group of the quaternary diesterammonium salts, the quaternary tetraalkylammonium salts, the quaternary diamidoammonium salts, the amidoamine esters and imidazolium salts. These are preferably present in the laundry conditioning rinse compositions in an amount of from 3 to 30% by weight. Examples are quaternary diesterammonium salts which have two C11- to C22-alk(en)ylcarbonyloxy(mono- to pentamethylene) radicals and two C1- to C3-alkyl or -hydroxyalkyl radicals on the quaternary nitrogen atom and, for example, chloride, bromide, methosulfate or sulfate as counterion.

Quaternary diesterammonium salts further include in particular those which have a C11- to C22-alk(en)ylcarbonyloxytrimethylene radical bearing a C11- to C22-alk(en)ylcarbonyloxy radical on the central carbon atom of the trimethylene group and three C1- to C3-alkyl or -hydroxyalkyl radicals on the quaternary nitrogen atom and, for example, chloride, bromide, methosulfate or sulfate as counterion.

Quaternary tetraalkylammonium salts are in particular those which have two C1- to C6-alkyl radicals and two C8- to C24-alk(en)yl radicals on the quaternary nitrogen atom and, for example, chloride, bromide, methosulfate or sulfate as counterion.

Quaternary diamidoammonium salts are in particular those which bear two C8- to C24-alk(en)ylcarbonylamino-ethylene radicals, a substituent selected from hydrogen, methyl, ethyl and polyoxyethylene having up to 5 oxyethylene units and as fourth radical a methyl group on the quaternary nitrogen atom and, for example, chloride, bromide, methosulfate or sulfate as counterion.

Amidoamino esters are in particular tertiary amines bearing a C11- to C22-alk(en)ylcarbonylamino(mono- to trimethylene) radical, a C11- to C22-alk(en)ylcarbonyloxy (mono- to trimethylene) radical and a methyl group as substituents on the nitrogen atom.

Imidazolinium salts are in particular those which bear a C14- to C18-alk(en)yl radical in position 2 of the heterocycle, a C14- to C18-alk(en)ylcarbonyl(oxy or amino)ethylene radical on the neutral nitrogen atom and hydrogen, methyl or ethyl on the nitrogen atom carrying the positive charge, while counterions here are for example chloride, bromide, methosulfate or sulfate.

The examples hereinbelow illustrate the invention.

EXAMPLES

The percentages in the examples are by weight, unless the context suggests otherwise.

Example 1

Amidation of Polyethyleneimine (MW 25 000) with Stearic Acid

In a 2 l stirred apparatus equipped with a distillation head, 680 g of polyethyleneimine (MW 25 000) were heated to 150° C. under nitrogen. 45 g of stearic acid were added a little at a time. The mixture was then stirred at 180° C. for 24 h while the water of reaction was distilled off. This provided a highly viscous water-soluble product.

Example 2

Reaction of a Cationic Polymer with Alkylketene Dimer 649 g of a 23% by weight aqueous solution of a polymer of diethylenetriamine and adipic acid (weight ratio 40:60) which had been grafted with ethyleneimine (in a weight ratio 1:1) and then crosslinked with a polyethylene oxide bischlorohydrin crosslinker (34 ethylene oxide units, 30% by weight based on the ready-prepared polymer)—total molar mass 2 000 000—were heated to 90° C. This mixture was admixed with a solution of 0.97 g of stearyldiketene (lactone content: 87.8%) in 5 ml of THF. The mixture was subsequently stirred at 90° C. for 3 h. The small amount of THF was distilled off in the process. This provided a dispersion having a solids content of 23%.

Example 3

Quaternization of a Polyethyleneimine Modified with Stearic Acid

The amidation of polyethyleneimine (MW 25 000) with stearic acid was carried out similarly to example 1.

4.6 g of the product thus prepared were dissolved in 50 ml of toluene. 26.7 g of dimethyl sulfate were slowly added dropwise at 100° C. The product was precipitated in the course of the reaction. The mixture was stirred at 100° C. for a further 5 h. Toluene was then decanted off and the remaining solid residue was thoroughly washed with acetone and dried. This provided a yellowish water-soluble wax.

Example 4

Hydrophobicization of Polyethyleneimine with Stearic Acid and Subsequent Alkoxylation The amidation of polyethyleneimine (MW 25 000) with stearic acid was carried out similarly to example 1.

500 g of the product thus prepared were dissolved in 500 g of water and heated to 100° C. 433 g of ethylene oxide gas were injected at this temperature. This provided an aqueous polymer solution having a solids content of 65%.

Example 5

Alkoxylation of Polyethyleneimine and Subsequent Hydrophobicization by Esterification with Stearoyl Chloride 2.1 kg of a 60% by weight aqueous solution of polyethyleneimine (MW 2 000) were reacted with 1.15 kg of ethylene oxide at 100° C. The reaction mixture was subsequently admixed at 50° C. with 125 g of a 50% by weight aqueous solution of potassium hydroxide and with 1.15 l of xylene. The water was removed with a Dean-Stark apparatus and the reaction mixture was reacted with 7.78 kg of ethylene oxide at 150° C. Xylene was distilled off, the reaction mixture was stripped with steam and the water was removed by distillation.

500 g of the water-free product thus obtained were heated to 80° C. 10.0 g of stearoyl chloride were added over 15 min, and the mixture was subsequently stirred at 80° C. for 2 h. This provided a water-soluble product which was waxy at room temperature.

Example 6

Hydrophobicization of Polyvinylamine with 1,2-octadecyl Epoxide and Subsequent Alkoxylation 200 g of an 8.6% by weight aqueous polyvinylamine solution (MW 30 000, pH 11.9, degree of hydrolysis 98.6%, desalted) were admixed with 1.60 g of a melt of octadecyl epoxide. The reaction mixture was stirred at 90° C. for 40 h.

100 g of the above reaction solution were reacted with 26.0 g of butylene oxide at 90° C. After cooling to 50° C., 1.7 g of a 50% by weight aqueous solution of potassium hydroxide and 300 g of xylene were added, the water was removed using a Dean- Stark apparatus and the reaction mixture was reacted with 34.8 g of ethylene oxide.

Xylene was distilled off and the reaction mixture was subsequently stripped with steam. This provided the product as an aqueous solution.

Finishing of Fabric Samples

The finish used was a 1% by weight aqueous solution or dispersion of the polymers of examples 1 to 6.

Cotton fabrics having the size quoted in each case in table 1 and a basis weight of 160 g/m2 were sprayed on both sides with the finishes of examples 1–6 so that the add-on was 2%, based on the respective weight of the dry textile material, and then while slightly moist ironed hot.

The fabric samples thus treated and, for comparison, untreated fabric samples of the same size were washed in the presence of ballast fabric with a liquid detergent at 40° C. in an automatic domestic washing machine (load in the range from 1.5 to 3.0 kg) and then tumble dried. A standard washing program and a standard drying program (respectively 40° C. colored wash and the cupboard dry program) were used. After drying, the sheetlike fabric samples were visually rated on the lines of AATCC test method 124, where a rating of 1 indicates that the fabric is highly wrinkled and has many creases and a rating of 5 is awarded to wrinkle- and crease-free fabric. The fabric samples pretreated with the finishes A, B and C received ratings in the range from 2 to 3.5. By contrast, the untreated fabric samples were each rated 1.

TABLE 1

| | Cotton (40 cm × 40 cm) load 1.5 kg | Cotton (40 cm × 40 cm) load 3.0 kg | Cotton (40 cm × 80 cm) load 1.5 kg |
|---|---|---|---|
| untreated | 1 | 1 | 1 |
| 1 | 3.5 | 2.5 | 2.5 |
| 2 | 3 | 2 | 2.5 |
| 3 | 3.5 | 3 | 3 |
| 4 | 3 | 2.5 | 3 |
| 5 | 2 | 2 | 2 |
| 6 | 3 | 2 | 2.5 |

We claim:

1. A process for wrinkleproofing cellulosic textiles comprising:

treating the textiles with a finish and drying the treated textiles, wherein the finish comprises one or more water-soluble or water-dispersible hydrophobically modified polyethyleneimines, polyvinylamines, or both polyethyleneimines and polyvinylamines, wherein the polyethyleneimines and polyvinylamines are hydrophobically modified by the at least partial replacement of the hydrogen of their primary and secondary amino groups by linear or branched alkyl, alkenyl, hydroxyalkyl or alkylcarboxy radical having 10 to 22 carbon atoms.

2. The process of claim 1, wherein the finish comprises hydrophobically modified ethyleneimine homopolymers crosslinked by polyfunctional crosslinking compounds.

3. The process of claim 1, wherein the the finish comprises hydrophobically modified graft polymers of at least one of a polyamidoamine and a polyvinylamine, which may be crosslinked by polyfunctional crosslinking compounds.

4. The process of claim 1, wherein the finish comprises at least partially hydrolyzed homo- or copolymers of N-vinylcarboxamides which may be crosslinked by polyfunctional crosslinking compounds.

5. The process of claim 1, wherein the finish comprises at least one of a hydrophobically modified polyethyleneimine and a polyvinylamine that are at least one of quaternized and modified by reaction with at least one of an alkylene oxide a, dialkyl carbonate, an alkylene carbonate and a C1–C4-carboxylic acid.

6. The process of claim 1, wherein the degree of hydrophobicization of the hydrophobically modified polyethyleneimines or polyvinylamines is from 0.1 to 20% by weight of hydrophobicizing reagent, based on the ready-prepared product.

7. A textile treatment composition comprising a) from 0.1 to 40% by weight of at least one of a hydrophobically modified polyethyleneimine and a hydrophobically modified polyvinylamine, b) from 0 to 30% by weight of one or more silicones, c) from 0 to 30% by weight of one or more cationic and/or nonionic surfactants, d) from 0 to 60% by weight of further ingredients such as further wetting agents, softeners, lubricants, water-soluble, film-forming and adhesive polymers, scents, colorants, stabilizers, fiber and color protection additives, viscosity modifiers, soil release additives, corrosion control additives, bactericides, preservatives and spraying assistants, and e) from 0 to 99.9% by weight of water, the components a) to e) adding up to 100% by weights wherein the polyethyleneimines and polyvinylamines are hydrophobically modified by the at least partial replacement of the hydrogen of their primary and secondary amino groups by linear or branched alkyl, alkenyl, hydroxyalkyl or alkylcarboxy radical having 10 to 22 carbon atoms.

8. A solid laundry detergent composition comprising a) from 0.05 to 20% by weight of at least one of a hydrophobically modified polyethyleneimine and a hydrophobically modified polyvinylamine, b) from 0 to 20% by weight of one or more silicones, c) from 0.1 to 40% by weight of at least one nonionic and/or anionic surfactant, d) from 0 to 50% by weight of one or more inorganic builders, e) from 0 to 10% by weight of one or more organic cobuilders, f) from 0 to 60% by weight of further customary ingredients such as standardizers, enzymes, perfume, complexing agents, corrosion inhibitors, bleaches, bleach activators, cationic surfactants, bleach catalysts, dye transfer inhibitors, antiredeposition agents, soil release polyesters, colorants, bactericides, dissolution improvers and/or disintegrants, components a) to f) adding up to 100% by weight wherein the polyethyleneimines and polyvinylamines are hydrophobically modified by the at least partial replacement of the hydrogen of their primary and secondary amino groups by linear or branched alkyl, alkenyl, hydroxyalkyl or alkylcarboxy radical having 10 to 22 carbon atoms.

9. A liquid laundry detergent composition comprising a) from 0.05 to 20% by weight of at least one of hydrophobically modified polyethyleneimine and a hydrophobically modified polyvinylamine, b) from 0 to 20% by weight of one or more silicones, c) from 0.1 to 40% by weight of at least one nonionic and/or anionic surfactant, d) from 0 to 20% by weight of one or more inorganic builders, e) from 0 to 10% by weight of one or more organic cobuilders, f) from 0 to 60% by weight of other customary ingredients such as sodium carbonate, enzymes, perfume, complexing agents, corrosion inhibitors, bleaches, bleach activators, bleach catalysts, cationic surfactants, dye transfer inhibitors, antiredeposition agents, soil release polyesters, colorants, bactericides, nonaqueous solvents, solubilizers, hydrotropes, thickeners and/or alkanolamines, g) from 0 to 99.85% by weight of water, components a) to g) adding up to 100% by weight wherein the polyethyleneimines and polyvinylamines are hydrophobically modified by the at least partial replacement of the hydrogen of their primary and secondary amino groups by linear or branched alkyl, alkenyl, hydroxyalkyl or alkylcarboxy radical having 10 to 22 carbon atoms.

10. A laundry conditioning rinse composition comprising a) from 0.05% to 40% by weight of at least one of a hydrophobically modified polyethyleneimine and a hydrophobically modified polyvinylamine, b) from 0 to 20% by weight of one or more silicones, c) from 0.1 to 40% by weight of at least one cationic surfactant, d) from 0 to 30% by weight of one or more nonionic surfactants, e) from 0 to 30% by weight of further customary ingredients such as silicones, other lubricants, wetting agents, film-forming polymers, scents, colorants, stabilizers, fiber and color protection additives, viscosity modifiers, soil release additives, corrosion control additives, bactericides and preservatives, and f) from 0 to 99.85% by weight of water, components a) to f) adding up to 100% by weight wherein the polyethyleneimines and polyvinylamines are hydrophobically modified by the at least partial replacement of the hydrogen of their primary and secondary amino groups by linear or branched alkyl, alkenyl, hydroxyalkyl or alkylcarboxy radical having 10 to 22 carbon atoms.

* * * * *